US009997134B2

(12) United States Patent
Smolic et al.

(10) Patent No.: US 9,997,134 B2
(45) Date of Patent: Jun. 12, 2018

(54) CHROMATIC CALIBRATION OF AN HDR DISPLAY USING 3D OCTREE FORESTS

(71) Applicant: Disney Enterprises, Inc., Burbank, CA (US)

(72) Inventors: Aljosa Smolic, Burbank, CA (US); Nikolce Stefanoski, Burbank, CA (US); Tunc Ozan Aydin, Burbank, CA (US); Jing Liu, Burbank, CA (US); Anselm Grundhofer, Burbank, CA (US)

(73) Assignee: DISNEY ENTERPRISES, INC., Burbank, CA (US)

( * ) Notice: Subject to any disclaimer, the term of this patent is extended or adjusted under 35 U.S.C. 154(b) by 340 days.

(21) Appl. No.: 14/612,074

(22) Filed: Feb. 2, 2015

(65) Prior Publication Data

US 2016/0225342 A1 Aug. 4, 2016

(51) Int. Cl.
*G09G 5/02* (2006.01)
*G09G 5/06* (2006.01)

(52) U.S. Cl.
CPC ..... *G09G 5/06* (2013.01); *G09G 5/026* (2013.01); *G09G 2320/0693* (2013.01); *G09G 2340/06* (2013.01)

(58) Field of Classification Search
None
See application file for complete search history.

(56) References Cited

U.S. PATENT DOCUMENTS 5,835,099 A * 11/1998 Marimont ..... G06T 11/001 345/591
7,002,571 B2 * 2/2006 Lake ..... G06T 17/005 345/420
8,654,141 B2 * 2/2014 Zhang ..... H04N 9/67 345/589
9,414,052 B2 * 8/2016 Cabral ..... H04N 5/3572
2005/0068332 A1 * 3/2005 Diefenbaugh ..... G09G 3/3413 345/604
2010/0245381 A1 * 9/2010 Samadani ..... G09G 5/06 345/593

(Continued)

OTHER PUBLICATIONS

Larson, Gregory Ward, The LogLuv Encoding for Full Gamut, High Dynamic Range Images, Silicon Graphics, Inc.*

(Continued)

*Primary Examiner* — Kent W Chang
*Assistant Examiner* — Nathaniel P Brittingham
(74) *Attorney, Agent, or Firm* — Fay Kaplun & Marcin, LLP

(57) ABSTRACT

Methods and systems for calibrating devices reproducing high dimensional data, such as calibrating High Dynamic Range (HDR) displays that reproduce chromatic data. Methods include mapping input data into calibrated data using calibration information retrieved from spatial data structures that encode a calibration function. The calibration function may be represented by any multidimensional scattered data interpolation methods such as Thin-Plate Splines. To efficiently represent and access the calibration information in runtime, the calibration function is recursively sampled based on guidance dataset. In an embodiment, an HDR display may be adaptively calibrated using a dynamic color guidance dataset and dynamic spatial data structures.

17 Claims, 8 Drawing Sheets

(56) References Cited

U.S. PATENT DOCUMENTS

| | | | | |
|---|---|---|---|---|
| 2012/0075435 | A1* | 3/2012 | Hovanky | H04N 13/02 348/51 |
| 2014/0111505 | A1* | 4/2014 | Hayashi | G09G 3/20 345/214 |
| 2016/0225342 | A1* | 8/2016 | Smolic | G09G 5/02 |

OTHER PUBLICATIONS

Froelich et al, Encoding Color Difference Signals for High Dynamic Range and Wide Gamut Imagery, Dolby Laboratories Inc., 2015 Societ for Imaging Science and Technology.*

Samet, Hanan, An Overview of Quadtrees, Octrees, and Related Hierarchical Data Structures, 1988, NATO ASI Series, vol. F40, pp. 52-56.*

Narwaria et al., Study of High Dynamic Range Video Quality Assessment, Sep. 22, 2015, SPIE Optical Engineering Conference Proceedings, vol. 9599. (Year: 2015).*

* cited by examiner

CHROMATIC CALIBRATION OF AN HDR DISPLAY USING 3D OCTREE FORESTS

FIELD OF INVENTION

Embodiments of the present invention relate to methods and systems for calibrating devices reproducing high dimensional data, such as calibrating High Dynamic Range (HDR) displays that reproduce chromatic data.

BACKGROUND OF INVENTION

Various devices are designed to translate high dimensional data from one medium to another with the goal of reproducing the same measurable information. For example, imaging devices, such as displays, are designed with the goal of producing chromatic radiances (i.e. color pixels) with spectral composition identical to those provided at their input. In practice, imaging devices introduce distortions; identical reproduction of color is not feasible. To remedy this, known calibration methods are employed where input color pixel values are altered so that when provided to the imaging device input, the device reproduces output color pixel values that are perceptually identical to the corresponding input color pixel values.

HDR displays or HDR projectors are examples of devices where chromatic calibration is required. HDR content, captured by HDR cameras, features contrast range and richness of color that closely resemble the human viewer perception of the real world. In contrast to the common Standard Dynamic Range (SDR) displays, HDR displays are capable of producing images with extremely bright regions alongside notably dark regions; a striking contrast that is enabled by recent innovations in local dimming technologies. Production studios already capture content in HDR format. To enable creative post-production processes (e.g. color grading), displaying this content with high color fidelity is of high importance. High rendering quality is also instrumental for 3D engineering design (e.g. CAD) where accurate visualization of materials' reflectance and dynamic may be critical for better design decision making. The realistic color and reflection representation provided by HDR enabled displays may also be essential for many scientific and research tasks that rely on accurate simulations to form diagnoses or tune complex algorithms.

Recent display technologies allow for ever increasing image resolution, up to the high-end image resolution of the Ultra High Definition (UHD) TV. These technological developments substantially improved the observable details in the broadcast video. However, limited dynamic range (of around $$0.1 - 100\ \frac{\text{cd}}{\text{m}^2})$$

prevents the rendering of brightness levels that are typical of real scenes (e.g. day light reflected from surfaces may surpass $$10{,}000\ \frac{\text{cd}}{\text{m}^2}$$

and the darkness of the night may be way below $$0.1\ \frac{\text{cd}}{\text{m}^2}).$$

Furthermore, the gamut (i.e. displayable color space) of current display technologies is limited. Example gamut definitions are provided in the International Telecommunication Union Recommendation ("ITU-R") BT. 601 "Studio Encoding Parameters of Digital Television for Standard 4:3 and Wide-Screen 16:9 Aspect Ratios" and BT. 709 "Parameter Values for the HDTV Standards for Production and International Programme Exchange" (see http://www.itu.ch). ITU standards may be referred to herein as "ITU BT. [number]" or simply "Rec. [number]" such as "Rec. 601" and "Rec. 709". Hence, wide gamut is required to significantly improve viewers' experience (see Rec. 2020 for wide gamut standard definition).

Depending on the specific display technology, displays introduce characteristic (device-dependent) distortions. These distortions may be represented by a deformation field and compensated for by a transform (calibration) function. For example, inventors observed that chromatic data at the input to an HDR display undergo nonlinear distortion that varies with luminance, as will be explained in detail below. Thus, the chromatic and luminance data constitute a volumetric space that may be deformed by the displaying device. In other words, color points from the input gamut when fed into the displaying device deviate to other color points, a deviation that may be modeled and compensated for by a calibration function.

To perform calibration on an imaging device, the calibration function is evaluated for each input color value. The resulting calibrated color value is then fed into the device input. To reduce complexity a look-up-table (LUT) is typically used in runtime. To this end, during initialization phase the calibration function is evaluated for a given set of color values that are sampled from a volumetric grid. This results in the corresponding set of calibrated color values. This precalculated set of calibrated color values is then stored in the LUT. During runtime the LUT is accessed for each input color value to retrieve the corresponding LUT-stored calibrated color value. Hence, the memory size of the LUT and memory accessing time are of importance when realtime calibration is required. The LUT size is especially of concern when large high dimensional data are involved. To illustrate, an HDR image represents each color pixel with 33 bits (13 bits for luminance and 20 bits for chrominance). This results in a color space of $2^{33}$ times 33 bits (about 35.5 GB). For comparison, an SDR image uses 24 bits to represent a pixel color, resulting in a color space of about 50 MB. Thus, realtime calibration of large volumetric data calls for efficient calibration information representation and retrieval methods.

Efficient methods to represent and access a deformation field are needed to allow realtime calibration. Calibration of devices typically involves mapping input data points from one multi-dimensional space into another multi-dimensional space. This mapping may be represented by a deformation field. Possible representations are based on spatial data structures, capable of efficient n-dimensional data encoding and accessing. Specifically, in the three dimensional case such a spatial data structure may be hierarchical so that sub-regions are nested within their enclosing region—a property that allows for recursive construction and access. A type of such a spatial data structure is binary space partitioning (BSP). In BSP the spatial regions that are encoded by the union of all leaf-nodes regularly partition the entire space, although some variants of BSP allow leaf-nodes to overlap and to encode irregular region geometry. An octree data structure is a special case of axis-aligned BSP where the splitting of each region is done recursively into eight even-sized boxes, and repeats itself until a certain stopping criterion is met or a maximum splitting number is reached. The mechanism in which a spatial data structure is constructed to efficiently encode the data it represents is application dependent. Embodiments of this invention propose methods to calibrate a device in realtime, utilizing spatial data structures that are uniquely constructed to efficiently represent and access large calibration data.

BRIEF DESCRIPTION OF THE DRAWINGS

Embodiments of the invention are described with reference to the accompanying drawings.

DETAILED DESCRIPTION

Methods and systems for calibration of a device designed to receive high dimensional data as an input and produce measurable outputs based on the data are provided. As used in this disclosure, "a measurable output" means any physical device output such as light, sound, electromagnetic, motion, or any analog or digital signals. Examples for devices may include displays, projectors, sound generators or amplifiers, remote control mechanical devices, robotics, or any other type of electronic device capable of calibration. Embodiments of the invention disclosed herein describe chromatic calibration of imaging devices such as HDR displays. While a particular application domain is used to describe aspects of this invention, it should be understood that the invention is not limited thereto. Those skilled in the art with access to the teachings provided herein will recognize additional modifications, applications, and embodiments within the scope thereof and additional fields in which the invention would be of significant utility.

Figure 1:
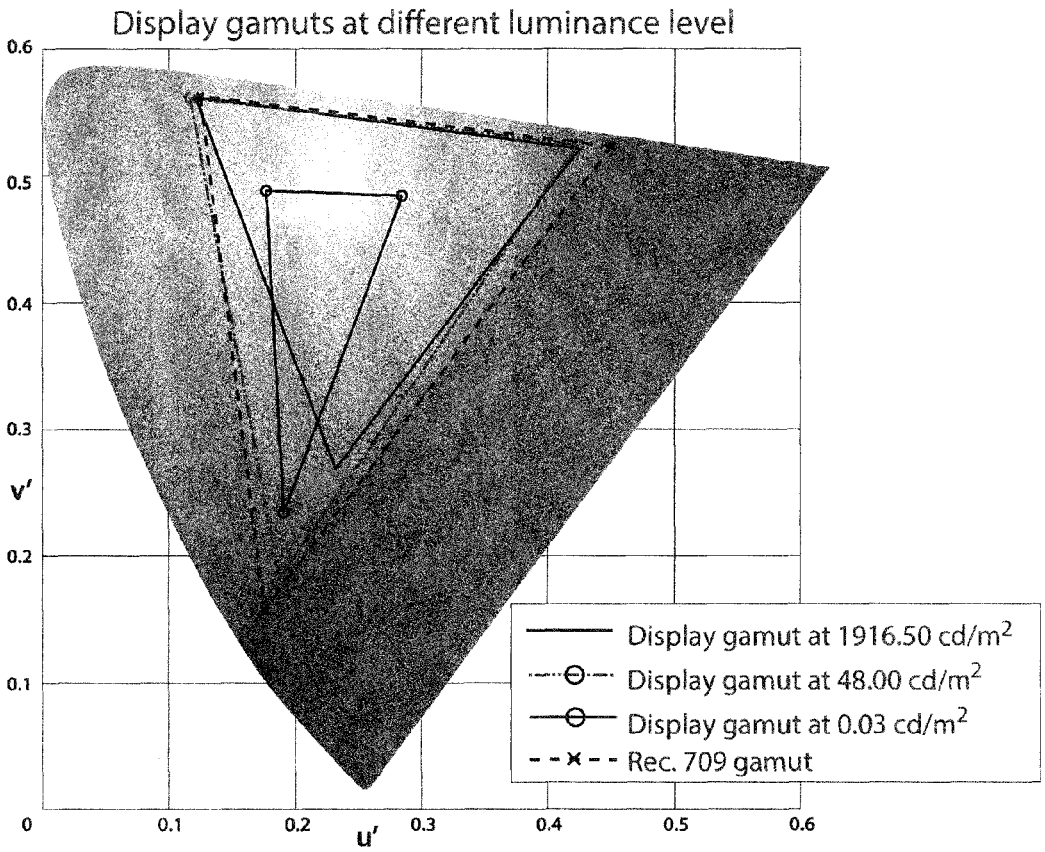
FIG. 1 shows a chromaticity diagram, including the Rec. 709 gamut and the gamuts of an HDR display at various luminance levels.

Myriad applications call for accurate and richer reproduction of colors. Hence, standards are available by the CIE (Commission Internationale d'Eclairage) for defining and measuring colors. FIG. 1 shows the chromaticity diagram, a planar section from the three dimensional CIE XYZ color space. The curved boundary therein outlines the color spectrum from the pure red (750 nm) through the pure green (520 nm) to the pure blue (380 nm) light wavelengths. The white color is located at about the center of the diagram. The closer a color point (u, v) is to the spectral line (farther from the white point), the more saturated the color it represents is. To fully describe a color a third dimension of luminance, Y, is needed. Generally, imaging devices are limited in their capability to produce colors. A device's displayable color space is represented by a triangle, namely a gamut. Displays are also limited in the illumination range they are capable of emitting. Thus, while the peak luminance of an HDR display may reach a brightness measure of $$4000\ \frac{\text{cd}}{\text{m}^2},$$

an SDR display typically reaches only about $$100\ \frac{\text{cd}}{\text{m}^2}.$$

FIG. 1 shows an HDR display's gamuts at various illumination levels relative to the Rec. 709 (or BT. 709) gamut.

Figure 2:
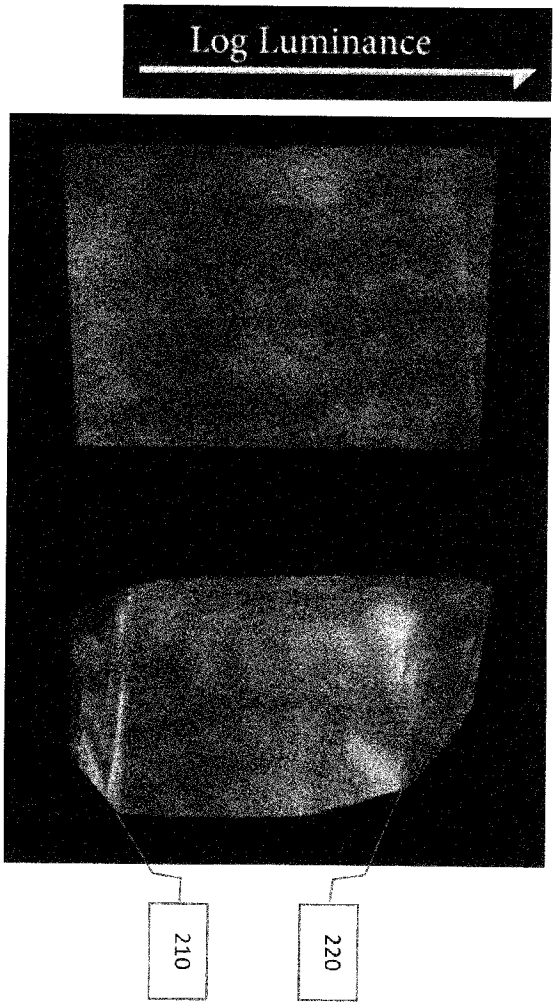
FIG. 2 shows visual comparison between the full Rec. 709 gamut volume (left) and the HDR display's gamut volume (right).

Inventors observed that an HDR display deforms the shape and size of the displayable gamut—a deformation that varies with luminance levels. These distortions are significant in regions of the gamut outside the standard dynamic range. Specifically, two color values with different luminance levels at the input of an HDR display, $(Y_1, u, v)$ and $(Y_2, u, v)$, convert into two output values with different chrominance values, $(Y_1, u_1, v_1)$ and $(Y_2, u_2, v_2)$, respectively. FIG. 1 illustrates the variation of reproduced primary colors at different luminance levels. It can be seen therein that the reproduced blue primary color experiences rapid reduction in saturation in the higher luminance levels. All reproduced primary colors loose saturation in lower luminance levels. FIG. 2 further illustrates how the volumetric color space (input Rec. 709 gamut on the left) is deformed into the reproduced volumetric color space (output gamut on the right). Strong deviation from the Rec. 709 gamut triangle is apparent in luminance levels approximately below $$1\ \frac{\text{cd}}{\text{m}^2}$$

and above $$100\ \frac{\text{cd}}{\text{m}^2},$$

respectively, 210 and 220. This deformation limits the exploitation of the full dynamic range available by HDR content at the device input and diminishes the intended viewer experience.

Figure 3:
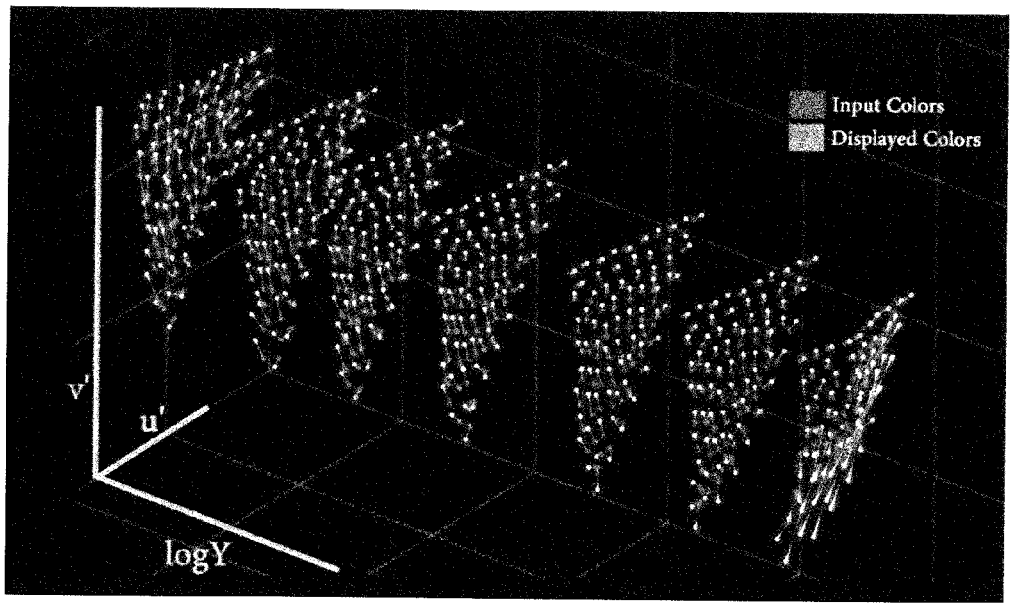
FIG. 3 shows a chrominance error field of an HDR display at various luminance levels.

In addition to the illumination-dependent deformation described above, inventors further observed that local error in the color reproduction exists within the same illumination level. FIG. 3 illustrates the error field at the various luminance levels. An error field is a volumetric space that comprises displacement vectors; each displacement vector indicates the magnitude and direction of a device-incurred color deviation (i.e. a difference between an input color value and its reproduced value at the device output). In FIG. 3 the displacement vectors extend from the dark points (input colors) to the bright points (displayed colors). It is apparent that significant nonlinear color reproduction errors exist throughout color planes with the same luminance as well as across the different luminance levels. It is also apparent that this nonlinear deviation is mostly smooth. Embodiments of this invention propose calibration methods that minimize the error field, and may be employed in realtime at various locations of the video distribution pipeline.

Figure 4:
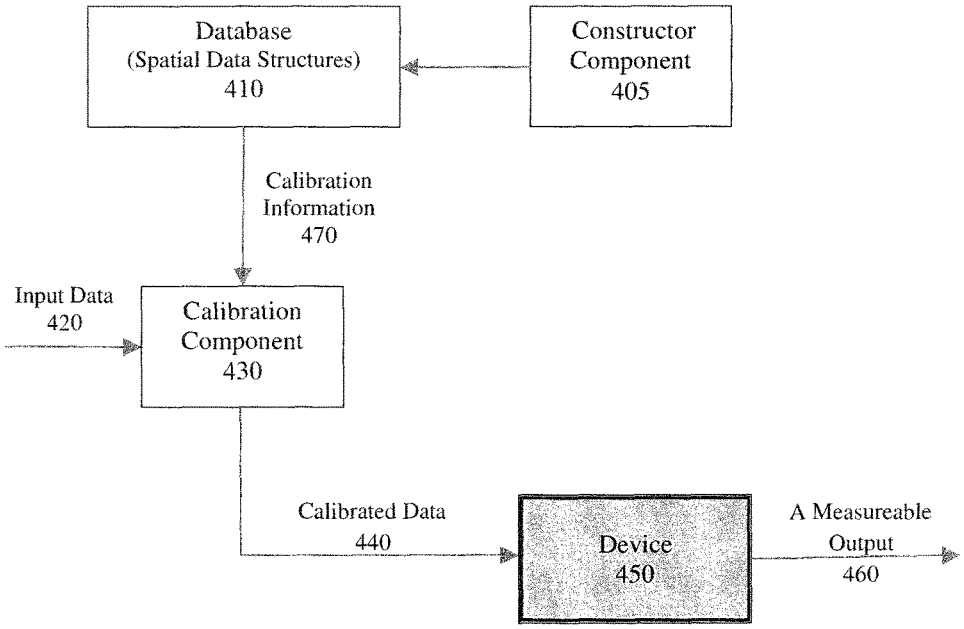
FIG. 4 shows a top level system's block diagram according to one embodiment of the disclosed invention.

A top level system description of an embodiment of the invention is shown in FIG. 4. Central to this system is a device 450 that processes high dimensional data according to the device's response function. The device may be primarily designed to generate a measurable output 460, based on the input data 420. Although the goal of the device designer may be to have the measurable output be an exactly accurate representation of the input data 420 (for example, if the device output 460 was measured by a highly accurate measurement device, the measured data would exactly match the input data), in practice, data processed by any physical device 450 undergo some erroneous deviation that may be compensated for by a calibration function. Such a calibration function may be executed by a process that resides in a calibration component 430. During runtime a database 410 is accessed to retrieve calibration information. The database includes spatial data structures that are constructed by a constructor component 405 to efficiently represent and index the calibration information. During the system's runtime, for each input value 420 the calibration component estimates a corresponding calibrated value 440 based on calibration information 470 it retrieves from the database 410. Calibrated data 440 is then fed into the device 450, resulting in measurable output 460 similar to the input data 420. For example, in an embodiment, the device is a display designed to reproduce an image 460 that is perceptually identical to a received image represented by input image data 420.

The system illustrated in FIG. 4 may be deployed in different configurations without departing from the breadth and scope of this invention's embodiments. For instance, the calibration component 430 and the database 410 may be embedded in the device 450 or be external to it. In an embodiment the database may be remotely located and accessible via a communication link. In another embodiment both the calibration component 430 and the database 410 may be located at a server end, wherein the server streams the calibrated data 440 to a device located at a client end via any communication link. Alternatively, the calibration component may be embedded in a capturing device such as a camera.

Embodiments of this invention are demonstrated herein in the context of minimizing the chromaticity error incurred by an HDR display 450. Specifically, the error field, representing a difference (i.e. distance) in value between the input colors and the corresponding display's reproduced output colors. This difference may be may be modeled by a smooth nonlinear function. Various known smooth and nonlinear functions may be used to approximate the error field. For instance, basis functions, such as wavelets or spherical harmonics, may be used to represent a device's characteristic error field. One embodiment utilizes a Thin-Plate Splines (TPS)-based function to approximate the error field. A TPS-based function consists of linear combination of radial basis functions. Mathematically, TPS minimize the energy required to bend a thin sheet of metal so it will fit a given surface. Having a physical interpretation, being smooth, and with closed-form solution contribute to the popularity of TPS in applications such as nonlinear registration and shape matching.

Specifically, an HDR display maps input colors $c_i$ to a reproduced output color $c_o$:

$$D:G_i \rightarrow G_0, c_i \rightarrow c_0. \tag{1}$$

The input color $c_i$ is a data point in a $G_i$ space that constitutes the input gamut volume and includes all valid input colors. Similarly, the output color $c_0$ is a data point in a $G_0$ space that constitutes the output gamut volume and includes all reproduced output colors. In the case of an HDR display the input gamut volume consists of all colors in the Rec. 709 gamut at luminance level of up to $$4000\ \frac{\text{cd}}{\text{m}^2}.$$

As demonstrated in FIG. 2, the output gamut volume is only a subset of the input gamut volume: $G_o \subset G_i$. Ideally, an imaging device D should reproduce the same chromatic values it received at its input, following the relationship:

$$\chi(c_i)=\chi(D(c_i)), \chi:(Y,u,v) \rightarrow (u,v). \tag{2}$$

In practice, however, a one to one mapping is not achievable. Furthermore, as in the case of a device such as an HDR display, the output gamut volume is smaller than the input gamut volume ($G_o \subset G_i$), and, therefore, the focus is on calibrating the display so that it reproduces accurate output colors for these input colors within $G_0$. The goal in this case then is to minimize the error E that is reproduced by the display D:

$$E[D]=\Sigma_{c_i \in G_0} \|\chi(c_i)-\chi(D(c_i))\|^2 \tag{3}$$

According to embodiments of this invention a calibration function K may be devised that maps input colors (within $G_0$) into calibrated input colors (within $G_i$), so that the reproduction error is minimized:

$$E_{min}=\min_K \Sigma_{c_i \in G_0} \|\chi(c_i)-\chi(D(K(c_i)))\|^2 \tag{4}$$

Effectively, in order to improve the color reproduction accuracy, the calibration function K has to approximate the inverse of the display's color reproduction function: $K \approx D^-$.

Figure 5:
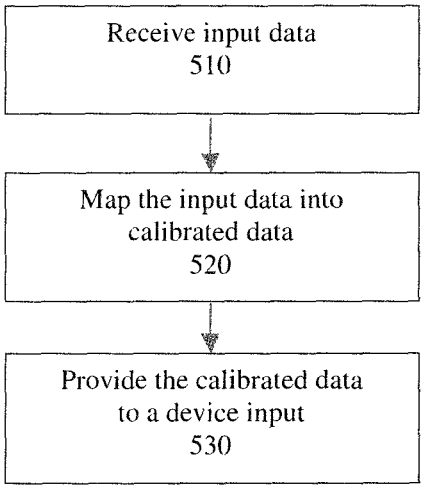
FIG. 5 shows a calibration process according to one embodiment of the disclosed invention.

FIG. 5 describes the main steps of calibrating high dimensional data according to embodiments of this invention. The calibration process is employed on input data received in step 510. The input data may be any measurable data such as volumetric chromatic data. Next, in step 520, the input data are mapped into corresponding calibrated data using calibration information retrieved from a database 410. The calibrated data is then fed into a device input for reproduction 530. The data stored in the database includes calibration information encoded into spatial data structures. These spatial data structures may be constructed during initialization phase or may be updated during runtime and include adaptive sampling of the calibration function. Hence, retrieved samples of the calibration function may be used to efficiently estimate a calibrated value 440 computed for each input value 420 as will be explained in detail below.

Figure 6:
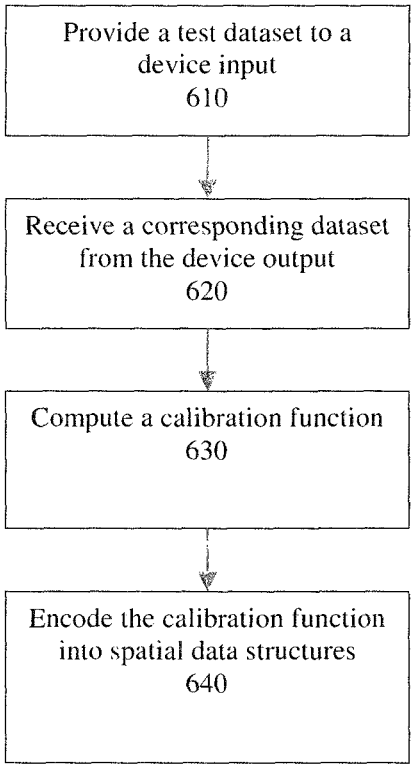
FIG. 6 shows a process for encoding the calibration function in spatial data structures according to one embodiment of the disclosed invention.

According to embodiments of this invention, the database 410 may consist of spatial data structures of an octree type, constituting an octree forest. The main steps of constructing the octree forest are described in FIG. 6. First, a test dataset is input to the device 450 in step 610. Then, the corresponding dataset is measured at the output of the device in step 620. For example, when the device is an HDR display, input color data from the test dataset may include data points distributed across the gamut volume. This may be done by sampling the gamut volume at concentric triangular prisms that are similar to the Rec. 709 gamut triangles. The corresponding dataset (output color data) may then be measured by a spectrometer positioned in front of the display. As explained above, in the case of an HDR display $G_o \subset G_i$, thereby causing some of the reproduced input color points (i.e. corresponding output color points) to be tightly distributed along the boundaries of $G_o$. Therefore, since it is preferable to have uniform distribution for data points $G_o$, in an embodiment, the color points that do not contribute to a uniform distribution may be considered as outliers and may be removed from the test dataset.

Once the test and corresponding datasets have been created (steps 610 & 620), the calibration function K may be computed in step 630. The calibration function may be represented by a smooth function computed based on the test and corresponding datasets. Embodiments of this invention may include calibration function K defined by any multidimensional scattered data interpolation methods such as Polyharmonic Splines or TPS. In an embodiment, a TPS-based approximator $K_{TPS}$ is used, where $K_{TPS}$ composed of weighted radial functions. $K_{TPS}$ is a nonlinear and smooth mapping function, and, as such, is well suited to approximate the error field illustrated in FIG. 3. However, a TPS-based approximator has a computation complexity that increases linearly with the number of measurements k (i.e. test dataset size) used to derive $K_{TPS}$. For example, it was found experimentally that a k of about 1000 may be needed to provide a good representation throughout the output gamut. Following the calibration function computation, the calibration function is encoded into spatial data structures (e.g. octree forest) and is stored in memory (e.g. a database 410) in step 640. As will be explained below, the calibration information encoded in the spatial data structures will be retrieved and used to efficiently map input data 420 into calibrated data 440 during runtime.

During runtime the calibration function may be directly invoked to map each given input data point into a new calibrated data point. When fed into the device 450 these calibrated data points result in measurable output data points that are significantly identical to the corresponding given input data points. In this case, the $K_{TPS}$ function is evaluated for each input data point with a complexity of O(k). Alternatively, to reduce the calibration processing time, instead of directly invoking the $K_{TPS}$ function for each input data point at runtime, $K_{TPS}$ may be pre-computed for all possible input data points (e.g. gamut grid samples). The resulting calibrated data points may then be stored in an LUT and be accessed as needed during runtime. However, this approach is not practical for a large data space. As indicated above, in the case of HDR content the LUT's size may be 35.5 GB. Embodiments of this invention propose methods that employ adaptive sampling of the calibration function (e.g. $K_{TPS}$) by means of spatial data structures, leading to a significant reduction in database 410 size and access time.

In an embodiment the calibration function is encoded into an octree forest. Therein, octree structures are constructed and used to adaptively sample the calibration function. The first step in constructing the octree forest includes partitioning the bounding box of the gamut volume into smaller volumetric cells, namely grid-cells. For example, the gamut volume $G_o$ may be partitioned into M×N×L grid-cells with edges aligned along the u, v, and log(Y) directions. For instance, edges in the u and v plane may be set to be with equal length while the length of edges in the direction of log (Y) may be set to be consistent with the luminance sensitivity of human vision. Next, an octree structure is constructed for each grid-cell. Thus, the octree structure determines an adaptive spatial sampling of the calibration function defined within its associated grid-cell volume.

A grid-cell associated with an octree structure is denoted by C and may be defined by its vertices and their positions in the gamut volume, $C \equiv (V_c, P_c)$. Particularly, a grid-cell C may be associated with eight vertices $V_c = \{v_1^C, \ldots, v_8^C\}$ positioned at spatial locations $P_c = \{p_1^C, \ldots, p_8^C\}$. In an embodiment, the process of splitting cell C into sub-cells may be guided by a guidance dataset S. For example, S may include a guidance color dataset selected from the gamut (e.g. $G_o$) that are specific to the nature of the reproduced content (e.g. HDR content). According to embodiments, the grid-cell C is recursively divided into sub-cells. The process of splitting is concluded when, for instance, one of two conditions is met: 1) the sub-cell does not contain any data from S or 2) a given maximum number of splitting $d_{max}$ has been reached. Although encoding the calibration function is disclosed herein using an octree structure, it is to be understood that other spatial data structures including other splitting techniques and criteria may be devised by those ordinarily skilled in the art without departing from the spirit or scope of the present invention.

Figure 7:
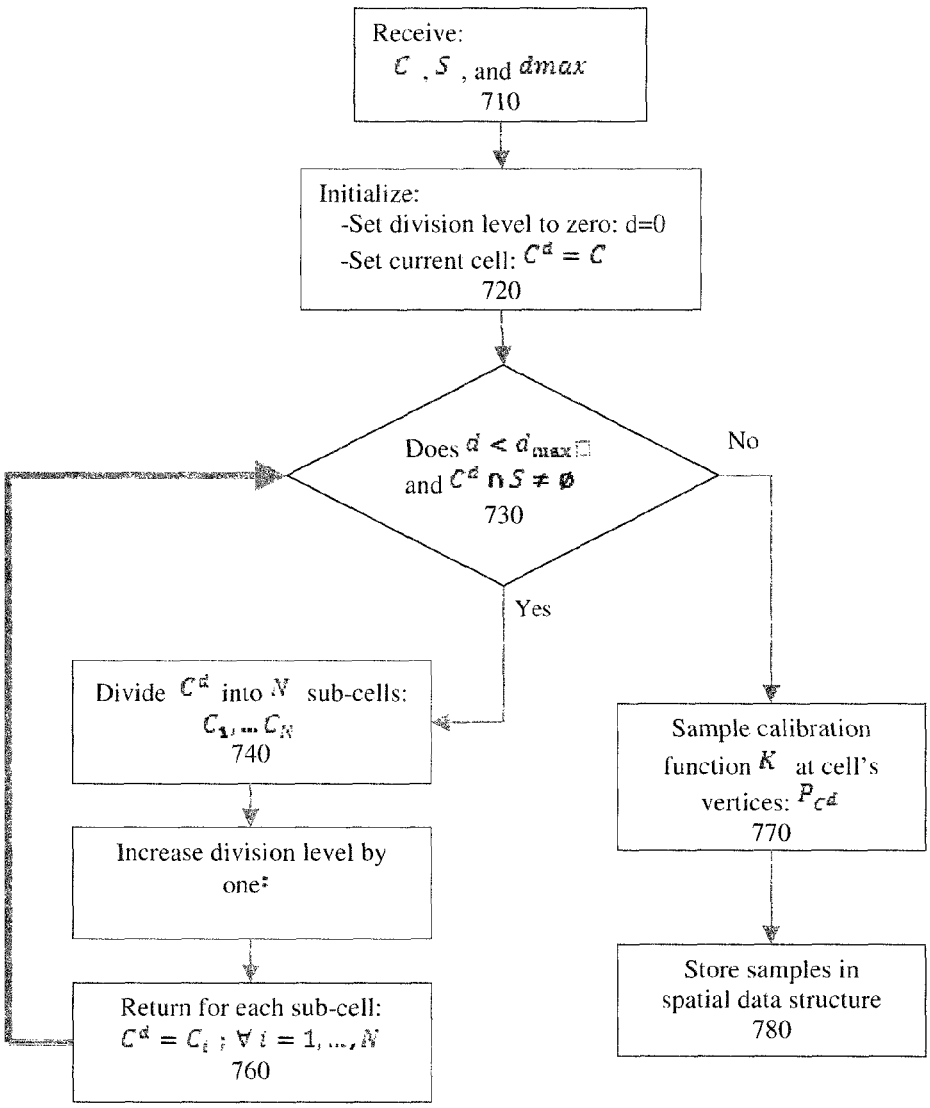
FIG. 7 shows a block diagram demonstrating an octree structure reconstruction according to one embodiment of the disclosed invention.

FIG. 7 shows a block diagram describing a recursive process through which an octree structure is constructed according to an embodiment. The process starts in step 710 with receiving a grid-cell C, a guidance dataset S, and a maximum number of allowed splits $d_{max}$. In the initialization step 720 the current level of the tree is set to zero, d=0, and the current cell $C^d$ is set to the grid-cell C. Next, in step 730 two conditions are tested to determine if to go forward and split the current cell into sub-cells: 1) if $d<d_{max}$ and 2) if any of the data from S overlap with any of the data associated with the cell $C^d$. If the conditions in step 730 are met, $C^d$ is divided into N=8 sub-cells: $C_1, \ldots, C_8$. As mentioned before, depending on the application, other conditions may be used to determine a splitting operation. For example, N may vary or cell division into irregular sub-cell geometries may be carried out instead of even-sized box division. Similarly, the second condition may include other metrics when comparing the guidance dataset against the data associated with cell $C^d$.

Next, in step 750 the tree level d is increased by one. Then, recursion starts in step 760 where for each sub-cell the process goes back to step 730 with $C^d = C_i$. When either one of the conditions in 730 is not met, the current sub-cell $C^d$ is not further divided and becomes a leaf-node. Every leaf-node is associated with a sub-cell defined by vertices located at $P_{C^d}$ within the gamut space. Hence, in step 770 the calibration function is sampled at the current sub-cell vertices, specifically $K_{TPS}$ is sampled at the $P_{C^d}$ locations. The samples are then saved together with other data associated with their leaf-node. When completed, the recursive process shown in FIG. 7 results in one octree data structure for each grid-cell C, including all leaf-nodes and their associated data. The octree data structures corresponding to all grid-cells (i.e. octree forest) effectively represent an adaptive sampling of the calibration function (e.g. $K_{TPS}$) within the space it supports (e.g. gamut space). This efficient sampling strikes a balance between the number of samples (which affects memory size and access time) and calibration function approximation accuracy.

Figure 8:
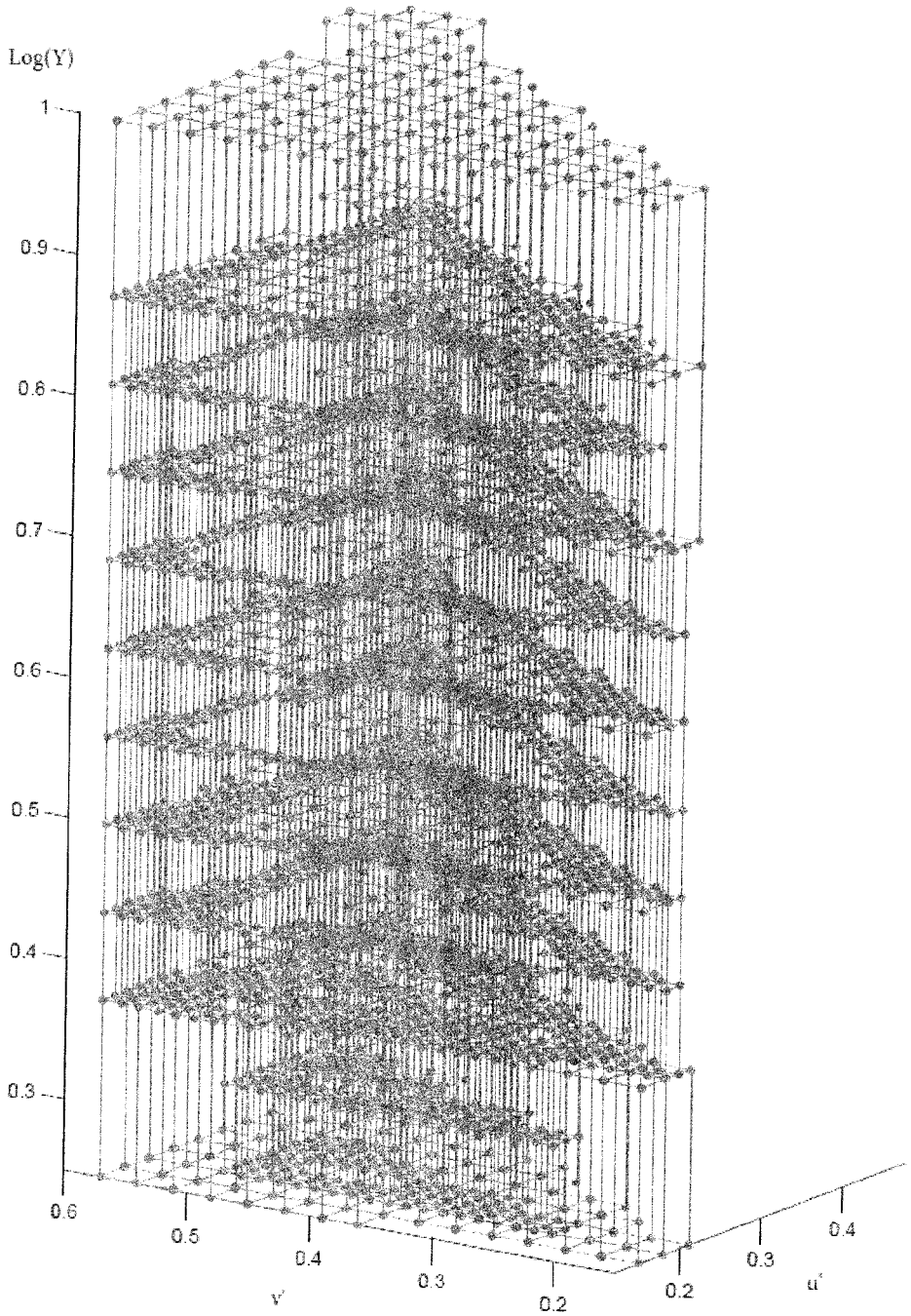
FIG. 8 shows a three dimensional visualization of an octree forest according to one embodiment of the disclosed invention.

The guidance dataset S may be used to control the calibration function approximation accuracy by allowing further sub-cells divisions in specific regions of the gamut volume. For example, embodiments may define S to include colors from the skin gamut area or colors around a given reference color (e.g. white point). Alternatively, selecting more guidance colors along the gamut boundary may improve the calibration function approximation in these regions due to better coverage by sub-cells that are fully contained within the gamut volume. FIG. 8 demonstrates an octree forest reconstructed according to embodiments of this invention. Initially, the gamut volume is partitioned into 20×20×10 grid-cells. An octree is then constructed for each cell. In FIG. 8 the lines represent the sub-cells' boundaries and the dots represent the vertices of these sub-cells (associated with leaf-nodes). As explained above, the calibration function is sampled at these vertices. It is apparent that the boundary cells are represented by octrees with high division levels, as a result the calibration function is densely sampled at the boundary regions.

The octree forest described above may be stored in a database 410 and made available for calibration at runtime. In an embodiment, the calibration component 430 estimates a calibrated data value 440 for each given input data value 420 based on calibration information encoded into the octree forest. Specifically, given an input color $c_i$, instead of directly calculating the calibrated value $K_{TPS}(c_i)$, an estimate is pursued using the octree forest as follows. First, the associated octree is accessed (i.e. the octree covering the space containing $c_i$). This octree is then traversed up to the smallest sub-cell $C_{sub}$ containing $c_i$. At that point $K_{TPS}(c_i)$ may be approximated based on calibration information encoded into the spatial vicinity of $C_{sub}$. For example, $K_{TPS}(c_i)$ may be approximated by trilinear interpolation using the uncalibrated colors $p_1^{C_{sub}}, \ldots, p_8^{C_{sub}}$ and the corresponding calibrated colors $K_{TPS}(p_1^{C_{sub}}), \ldots, K_{TPS}(p_8^{C_{sub}})$ associated with the vertices of $C_{sub}$. Hence, the data used to approximate $K_{TPS}(c_i)$ is precalculated and readily available at runtime.

According to embodiments of this invention the spatial data structures 410 may be static as well as dynamic. For example, when calibration is applied to input data undergoing continuous changes over time the spatial data structures may be varied in response to these changes. One mechanism to accomplish this is by updating the content of the guidance dataset S and reconstructing the octrees that are affected by this update. In another embodiment, the octree forest structure and encoded data may be updated over time due to physical changes in the device 450 that affect its characteristic response to the input data. A device's characteristic response may also be dependent on environmental changes such as temperature. In an embodiment changes in a device's characteristic response as a function of various factors may be modeled. Such modeling may then be used to update the octree forest structure and its encoded data.

The present invention has been described in terms of several embodiments solely for the purpose of illustration. Persons skilled in the art will recognize from this description that the invention is not limited to the embodiments described, but may be practiced with modifications and alterations limited only by the spirit and scope of the appended claims. For example, methods described above may be applied to the application of HDR projector calibration. Similarly, in an embodiment, a robot's motion may be calibrated, wherein spatial input data (representing a desired robot motion trajectory) may be mapped by a calibration function so that the difference between the spatial measurable output (i.e. robot actual motion trajectory) and the spatial input data is minimized.

What is claimed is:

1. A computer-implemented calibration method for calibrating a High Dynamic Range (HDR) device having a HDR device input and a HDR device output, comprising:

receiving input chromatic data, wherein the input chromatic data exists in a first color gamut;

mapping the input chromatic data into calibrated chromatic data using calibration information retrieved from a database, wherein the database includes octree data structures that represent a spatial sampling of a calibration function and wherein the calibrated chromatic data exists in a second color gamut;

providing the calibrated chromatic data to the HDR device input; and generating, at the HDR device output, a measurable output based on the calibrated chromatic data.

2. The method in claim 1, wherein the octree data structures are constructed by:

providing a test dataset to the HDR device input;

generating, at the HDR device output, a corresponding measurable output based on the test dataset;

measuring the corresponding measurable output, resulting in a corresponding dataset, wherein a difference in value between the test dataset and the corresponding dataset is a function of the HDR device's characteristics;

computing the calibration function based on the test dataset and the corresponding dataset, wherein the calibration function maps points from the second data space to points from the first data space to minimize the difference in value between the test dataset and the corresponding dataset; and encoding the calibration function into the octree data structures based on a guidance dataset.

3. The method in claim 1, wherein the providing the calibrated data comprises data transmission over a communication link.

4. The method in claim 1, wherein the using calibration information retrieved from the database comprises retrieving the calibration information from a remotely located database using transmission over a communication link.

5. The method in claim 2, wherein the HDR device is one of an HDR display and an HDR projector and the guidance dataset is a guidance color dataset.

6. The method in claim 1, wherein the calibration function is a Thin-Plate-Splines (TPS)-based approximator.

7. The method in claim 1, wherein at least one of the octree data structures is dynamic.

8. The method in claim 2, wherein the guidance dataset is dynamic.

9. A calibration system for calibrating a High Dynamic Range (HDR) device having a HDR device input and a HDR device output, comprising:

input chromatic data, wherein the input chromatic data exists in a first color gamut;

a database containing octree data structures, wherein the octree data structures represent a spatial sampling of a calibration function;

a calibration component configured to map the input chromatic data into calibrated chromatic data using calibration information retrieved from the database, wherein the calibrated chromatic data exist in a second color gamut; and the HDR device configured to receive the calibrated chromatic data, at the HDR device input, and generate, at the HDR device output, a measurable output based on the calibrated chromatic data.

10. The system in claim 9, further comprising a constructor component configured to construct the octree data structures and wherein construction comprises:

providing a test dataset to the HDR device input;

generating, at the HDR device output, a corresponding measurable output based on the test dataset;

measuring the corresponding measurable output, resulting in a corresponding dataset, wherein a difference in value between the test dataset and the corresponding dataset is a function of the HDR device's characteristics;

computing the calibration function based on the test dataset and the corresponding dataset, wherein the calibration function maps points from the second data space to points from the first data space to minimize the difference; and encoding the calibration function into the octree data structures based on a guidance dataset.

11. The system in claim 9, wherein the calibration component is located remotely to the HDR device and transmits the calibrated data to the HDR device via a communication link.

12. The system in claim 9, wherein the database is located remotely to the calibration component and transmits the calibration information to the calibration component via a communication link.

13. The system in claim 10, wherein the HDR device is one of an HDR display and an HDR projector and the guidance dataset is a guidance color dataset.

14. The system in claim 9, wherein the calibration function is a Thin-Plate-Splines (TPS)-based approximator.

15. The system in claim 9, wherein at least one of the octree data structures is dynamic.

16. The system in claim 10, wherein the guidance dataset is dynamic.

17. A non-transitory computer-readable storage medium storing a set of instructions that is executable by a processor, the set of instructions, when executed by the processor, causing the processor to perform operations comprising:

receiving input chromatic data, wherein the input chromatic data exists in a first color gamut;

mapping the input chromatic data into calibrated chromatic data using calibration information retrieved from a database, wherein the database includes octree data structures that encode a calibration function and wherein the calibrated chromatic data exists in a second color gamut;

providing the calibrated chromatic data to a HDR device input; and generating, at a HDR device output, a measurable output based on the calibrated chromatic data.

* * * * *